United States Patent [19]

McKim

[11] Patent Number: 4,643,365

[45] Date of Patent: Feb. 17, 1987

[54] APPARATUS FOR ADDING GRINDING MEDIA TO A GRINDING MILL

[75] Inventor: A. Meredith McKim, Oakville, Canada

[73] Assignee: Norcast Inc., Toronto, Canada

[21] Appl. No.: 752,651

[22] Filed: Jul. 8, 1985

[30] Foreign Application Priority Data

Jul. 17, 1984 [CA] Canada ..... 459091

[51] Int. Cl.[4] ..... B02C 17/18; B02C 23/00

[52] U.S. Cl. ..... 241/101.2; 222/414; 241/171; 241/301

[58] Field of Search ..... 222/414; 241/101.2, 241/171, 186.2, 186.4, 301

[56] References Cited

U.S. PATENT DOCUMENTS 2,737,319 3/1956 Rayburn ..... 222/414

*Primary Examiner*—Howard N. Goldberg
*Assistant Examiner*—Timothy V. Eley
*Attorney, Agent, or Firm*—Fleit, Jacobson, Cohn & Price

[57] ABSTRACT

An apparatus for adding grinding media to a grinding mill is disclosed. The apparatus comprises a supporting structure including a face plate adapted to be mounted on a wall of a hopper or pipe containing the grinding media, a resilient rubber wheel mounted on the supporting structure and protruding through a slot in the face plate and said wall of the media container, and means for rotating said wheel at a low speed for withdrawing grinding media from said container and delivering the same to other conveyances for direction to the grinding mill.

5 Claims, 4 Drawing Figures

APPARATUS FOR ADDING GRINDING MEDIA TO A GRINDING MILL

BACKGROUND OF THE INVENTION

1. Field of the Invention

This invention relates to an apparatus for adding grinding media to a grinding mill.

2. Description of Related Art

As commonly known, grinding mills are used to reduce the size of solid materials in a mineral processing plant such that they are amenable to further processing, for example, froth flotation. This size reduction is accomplished by means of apparatus which are found in industrial applications such as ball mills, rod mills, pebble mills, etc. The typical grinding mill with which the present invention is concerned is the ball mill and the present invention relates more particularly to a feeder for controlling the feed of the media to the mill. It is not uncommon that a ball mill may use a recipe of balls of different size or operate with non-spherical media which replaces the ball. The alternative media may be in the form of a cylinder, cone or variations of the two.

The conventional methods of feeding the grinding media to ball mills include:

1. The transport of balls by wheelbarrow or manually operated conveyance to a point at which the media may be fed through a chute or pipe by hand or, alternatively, shovelled or dumped from the wheelbarrow into the mill;

2. The transport of the media from a bulk storage facility by a special bottom dump bucket carried by a crane to a chute so arranged that, as the bottom dump bucket is lowered onto the chute, the bucket opens to discharge the entire contents of the bucket through the chute into the grinding mill;

3. The same as 2 above except the media is dumped into a day bin or hopper which may have a capacity of several bucket loads. From this day bin, a gate is opened periodically to allow an operator's estimate of the appropriate amount to run through chute work into the grinding mill;

4. Some feeders do exist which are mounted in the discharge piping from the day bin and comprise a steel drum in the surface of which are located pockets of appropriate size to accept one ball. When the drum is rotated, the balls are lifted over the top of the drum and dropped into the downstream side of the pipe in which the drum is mounted.

The problems associated with these methods of feeding media are respectively:

1. In small mills, hand feeding may be effective but it is a daily task performed on an intermittent basis;

2. Dumping full bucket loads of media into a mill causes a sharp rise in power draft which forms a cycle equivalent to the frequency of media addition. The frequency of media addition can also be made irregular due to erratic availability of a crane and the work forces used to do the job;

3. Similar problems exist when feeding is done from the day bin except that greater latitude is available for crane use due to the reserve attained in the bin. However, the same problems of cyclic power draft result from massive addition of media at any one time.

4. The feeder described is usable only on spherical shaped media of a specific size. It in no way causes the media to dislodge from the day bin if the media hangs up, nor can it handle media of any dimension other than a sphere of a specific size.

SUMMARY OF THE INVENTION

The apparatus, in accordance with the present invention comprises a supporting structure including a face plate adapted to be mounted to a wall of a hopper, a pipe or other existing facilities which contain the grinding media, a resilient rubber wheel protruding through a slot in the face plate and the wall of the media container, means for rotating the wheel at low speed for withdrawing the media from the container and delivering the same to other conveyances for direction to the grinding mill.

The means for rotating the wheel at a low speed preferably comprises a shaft on which the wheel is mounted, a fixed disc mounted on the shaft, a friction clutch engaging the disc, a lever rocking arm connected at one end to the friction clutch for driving the fixed disc and the shaft, and means for rocking the arm. The means for rocking the arm may be a motor driven crank or a linear reciprocating cylinder.

If a motor is used, it is preferably connected to the crank through a speed reducer so as to reduce the speed of the crank to about 5–20 revolutions per minute.

The invention will now be disclosed, by way of example with reference to a preferred embodiment illustrated in the accompanying drawings in which:

DETAILED DESCRIPTION OF THE DRAWINGS

Figure 1:
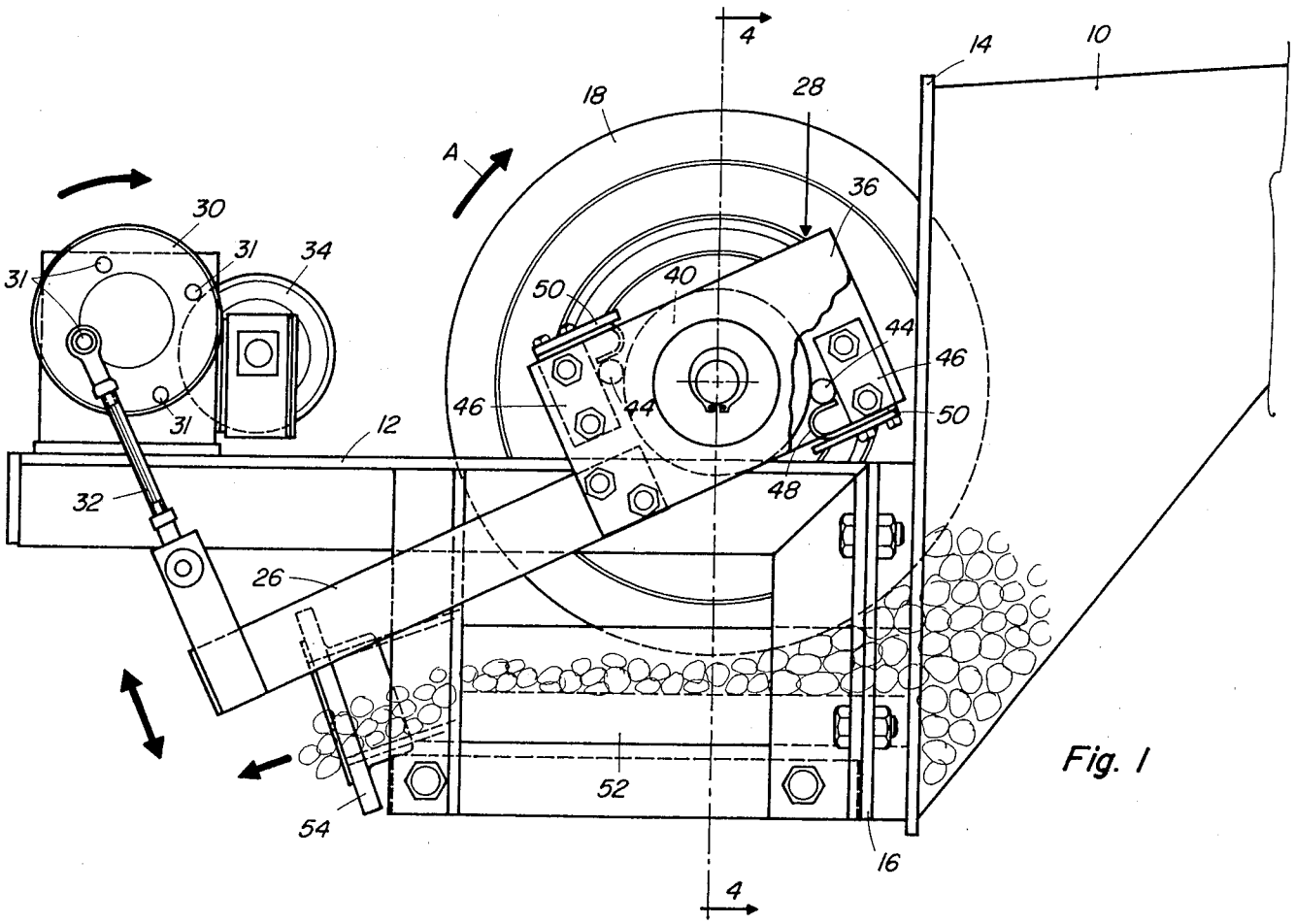
FIG. 1 is a side view of the apparatus in accordance with the invention.
Figure 2:
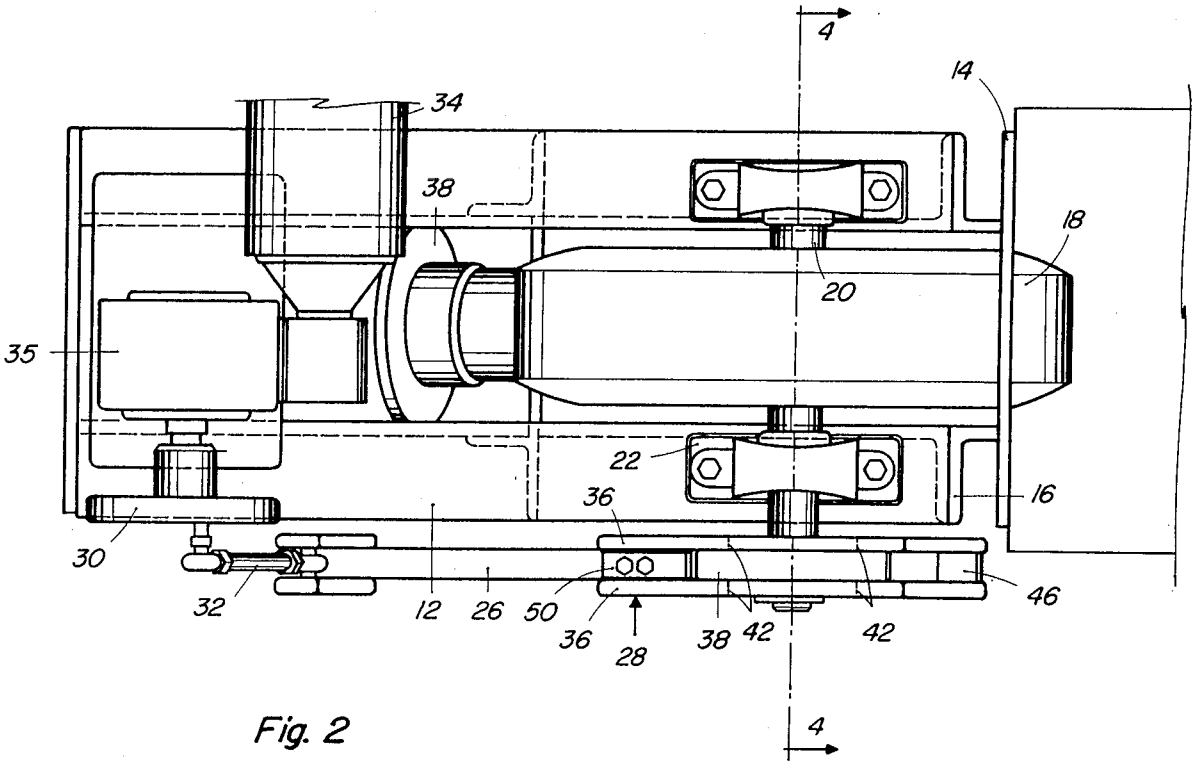
FIG. 2 is a top view of the apparatus shown in FIG. 1.

Referring to the drawings, there is shown a hopper 10 on which the apparatus in accordance with the invention is mounted. The apparatus comprises a supporting structure 12 upon which is secured a face plate 14 through adaptor flanges 16. The face plate is welded to a wall of the hopper 10. A rubber-tired wheel, such as an automobile tire 18, is mounted on a drive shaft 20 journalled in bearings 22, secured to the supporting structure 12. The wheel protrudes through a slot 24 (FIG. 1) in the face plate 14 and in the front wall of the hopper and is rotated at a slow speed by a rocking arm 26 through a friction clutch mechanism 28. The rocking arm is operated by a crank 30 having a choice of connections 31 for attachment to a connecting rod 32 to allow adjustment of the crank stroke. The crank is driven by a motor 34 through a speed reducing gear box 35.

The friction clutch comprises a pair of plates 36 secured to one end of rocking arm 26 and a disc 38 which is secured to the shaft 20. The disc 38 has opposite edge portions 40 of reduced diameter which rotate freely in one direction (counter-clockwise) in openings 42 in the plates but is restrained from rotation in the opposite direction by a pair of rollers 44 which are both jammed between a roller plate 46 and the central portion of the disc upon rotation of the rocking arm in that direction (clockwise). The roller 44 is biased by a spring 48 so as to remain in contact with the edge of the disc. The spring 48 is secured to the edges of the plates by small plates 50. Rocking of the arm thus rotates the wheel step by step in the direction of arrow A, as shown in FIG. 1 of the drawings.

Figure 4:
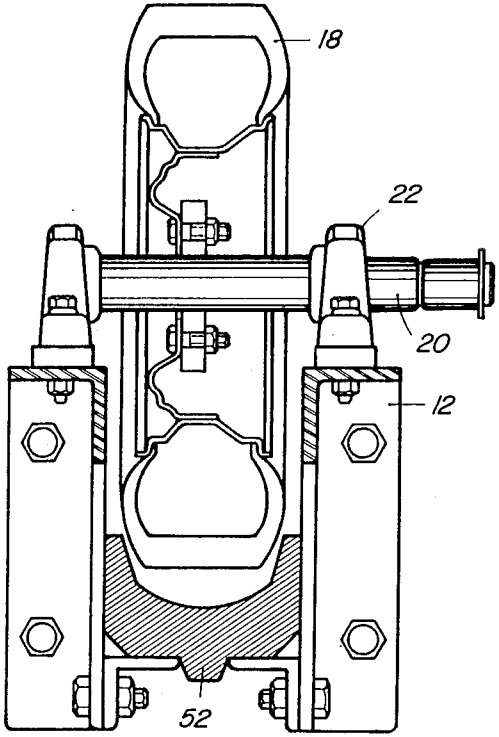
FIG. 4 is a section view through line 4—4 of FIG. 1.
Figure 3:
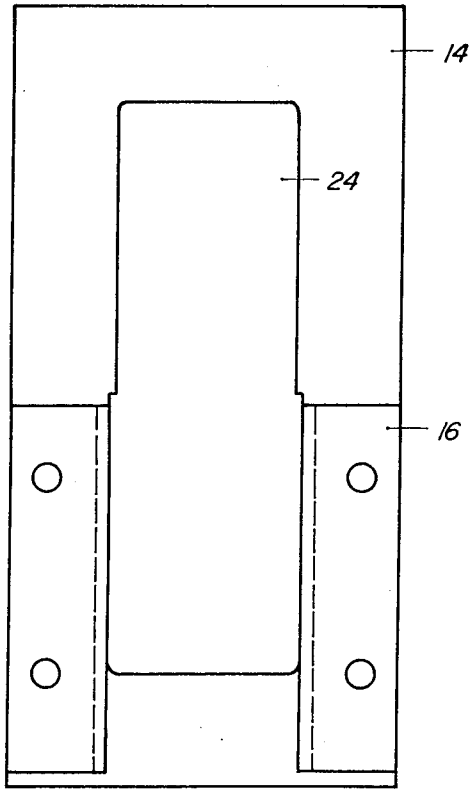
FIG. 3 is a plan view of the face plate of the apparatus of FIG. 1.

In operation, the motor 34 is energized continuously or intermittently to rotate the wheel 18 step by step at a low speed. By gravity and the influence of the downward travelling tread of the wheel, the media is drawn into the restricted opening between the perimeter of the wheel and an adjustable trough 52 mounted on the supporting structure 12 underneath the wheel. As the wheel rotates, the media rolls between the circumference of the wheel and the trough, as shown in FIGS. 1 and 4, and is discharged from the trough at outlet 54 where it is delivered, preferably by gravity, to the grinding mill.

The feeder control mechanism is adaptable to specific needs of each application. Addition of grinding media is typically made on the basis of a recognition that the power draft of the grinding mill has dropped below the desired maximum sufficiently to allow some mass of media to be added to the mill. This, in turn, returns the power draft to approximately desired value. Repeated execution of these procedures by operating forces describes for them within close limits how much can be added and how often.

The optimum power draft for best mill performance is at a value represented immediately after exactly the right size media addition has been made. Normally, this is maximum available mill power. Operation at any value below this represents a reduction in the capacity of the grinding mill in terms of either throughput or grinding size reduction.

Typical operating statistics will describe a consumption rate of grinding media that is essentially constant relative to the feed tonnage of ore fed to the grinding mill. This ratio may be used to describe a moment requirement of grinding media to match the consumption rate within the grinding mill so that maximum power may be drafted at all times.

The control system may utilize the continuous tabulation of feed tonnage of ore to the grinding mill or, in lieu of that information, the operator's input data as to the average feed rate so that in lieu of direct tonnage measurement real time is used as an inference to tonnage. These values dictate that, upon the introduction of some set weight of ore, i.e. one ton, the feeder will start; it will deliver units of grinding media which are individually counted and totalized using any suitable scanning device located adjacent outlet 54 until their collective weight equals or exceeds the required weight to match the tons fed in accordance with the ratio input by the operator at which point the feeder stops. All feed tons are totalized and all media units fed are totalized, and the two are compared continuously as a ratio with the input ratio at any one time.

Alternative control methods are possible, such as direct control from power draft. This allows that, while the power draft is below a set value, the feeder will operate continuously until the power draft rises to or above that point at which the feeder stops. In both systems, the feeder has a capacity which exceeds the requirements so that if there is an interruption in the supply of media to the feeder, upon re-establishment of the supply, the feeder has the capability to catch up on the deficit. This means that, in normal circumstances, its operation will be intermittent on demand.

Although the invention has been disclosed with reference to a preferred embodiment, it is to be understood that it is not limited to such embodiment and that other alternatives within the scope of the following claims are also envisaged. For example, the rocking arm 26 could be operated by a reciprocating cylinder. The friction clutch 28 can also take various forms. Furthermore, the apparatus in accordance with the invention can also be mounted on a delivery pipe instead of being mounted on a hopper.

I claim:

1. An apparatus for adding grinding media to a grinding mill comprising:

(a) a supporting structure including a face plate adapted to be mounted on a wall of a container which contains the grinding media;

(b) a resilient rubber wheel mounted on the supporting structure and protruding through a slot in the face plate and said wall of the container;

(c) a shaft on which the wheel is mounted;

(d) a fixed disc mounted on the shaft; and (e) a friction clutch engaging the disc for rotating said disc step by step at a low speed for withdrawing grinding media from said container and delivering the same to other conveyances for direction to the grinding mill.

2. An apparatus, as defined in claim 1, further comprising a lever rocking arm connected at one end to the friction clutch for driving the fixed disc and the shaft and means for rocking the arm.

3. An apparatus, as defined in claim 2, wherein the means for rocking the arm is a motor driven crank.

4. An apparatus, as defined in claim 3 further comprising a speed reducer interconnecting said motor to said drive shaft.

5. An apparatus, as defined in claim 2, wherein the means for rocking the arm is a linear reciprocating cylinder.

* * * * *